US010914086B2

(12) United States Patent
Boyd et al.

(10) Patent No.: US 10,914,086 B2
(45) Date of Patent: Feb. 9, 2021

(54) MOMENT CONNECTION COMPONENT GRIPPING APPARATUS

(71) Applicant: ConXtech, Inc., Pleasanton, CA (US)

(72) Inventors: John S. Boyd, Tiburon, CA (US); Kevin Marek, Hayward, CA (US); Eric Bellman, Hayward, CA (US); Maxwell C. Simmons, Hayward, CA (US); Robert J. Simmons, Hayward, CA (US); Kyle Joseph Palmiscno, Loveland, CO (US)

(73) Assignee: ConXtech, Inc., Pleasanton, CA (US)

( * ) Notice: Subject to any disclaimer, the term of this patent is extended or adjusted under 35 U.S.C. 154(b) by 79 days.

(21) Appl. No.: 16/271,746

(22) Filed: Feb. 8, 2019

(65) Prior Publication Data

US 2019/0249450 A1 Aug. 15, 2019

Related U.S. Application Data

(60) Provisional application No. 62/628,829, filed on Feb. 9, 2018, provisional application No. 62/628,807, filed on Feb. 9, 2018.

(51) Int. Cl.
*E04G 21/16* (2006.01)
*E04B 1/19* (2006.01)

(52) U.S. Cl.
CPC ..... *E04G 21/162* (2013.01); *E04B 1/1903* (2013.01); *E04B 2103/06* (2013.01)

(58) Field of Classification Search
CPC .. E04G 21/162; E04B 1/1903; E04B 2103/06
USPC ..... 294/67.22, 82.17, 82.19
See application file for complete search history.

(56) References Cited

U.S. PATENT DOCUMENTS 2,260,708 A * 10/1941 French ..... B25B 5/109 269/160
3,404,503 A 10/1968 Courtois et al.
3,584,830 A * 6/1971 Koehn ..... A61M 39/283 251/8
4,216,987 A 8/1980 Ely
4,371,203 A * 2/1983 Munro ..... B66C 1/64 294/103.1
4,705,312 A * 11/1987 Vooge ..... B65G 7/12 294/62
4,767,091 A 8/1988 Cuny
5,480,201 A 1/1996 Mercer
5,826,927 A * 10/1998 Long ..... B65G 7/12 294/15

(Continued)

OTHER PUBLICATIONS

U.S. Receiving Office of WIPO, International Search Report regarding PCT Patent Application No. PCT/US19/17372, dated Apr. 23, 2019, 5 pages.

(Continued)

*Primary Examiner* — Paul T Chin
(74) *Attorney, Agent, or Firm* — Kolisch Hartwell, P.C.

(57) ABSTRACT

A gripping apparatus is disclosed, including a rigid housing having a slot with an engagement axis, and a shaft extending parallel to the engagement axis. The apparatus further includes a tab member on a distal end of the shaft and a rotational actuator on a proximal end of the shaft. The rotational actuator is configured to rotate the shaft, causing the tab member to move between a hooked position and an unhooked position.

18 Claims, 5 Drawing Sheets

(56) References Cited

U.S. PATENT DOCUMENTS

| | | | | |
|---|---|---|---|---|
| 2007/0137008 | A1 | 6/2007 | Anstee | |
| 2008/0282643 | A1* | 11/2008 | Devens | E04G 21/162 52/749.13 |
| 2008/0295443 | A1 | 12/2008 | Simmons | |
| 2015/0091315 | A1 | 4/2015 | Butterfield, IV | |
| 2015/0123418 | A1 | 5/2015 | Bell | |
| 2019/0249451 | A1* | 8/2019 | Boyd | E04B 1/1903 |
| 2019/0249452 | A1* | 8/2019 | King, Jr. | B08B 5/04 |

OTHER PUBLICATIONS

U.S. Receiving Office of WIPO, Written Opinion of the International Searching Authority regarding PCT Patent Application No. PCT/US19/17372, dated Apr. 23, 2019, 5 pages.

* cited by examiner

MOMENT CONNECTION COMPONENT GRIPPING APPARATUS

CROSS-REFERENCES

This application claims the benefit under 35 U.S.C. § 119(e) of the priority of U.S. Provisional Patent Application Ser. No. 62/628,829, filed Feb. 9, 2018, and of U.S. Provisional Patent Application Ser. No. 62/628,807, filed Feb. 9, 2018, the entireties of which are hereby incorporated by reference for all purposes. U.S. Pat. No. 7,941,985 B2 is also incorporated by reference herein, in its entirety, for all purposes.

INTRODUCTION

Steel frame building construction requires connection of beams and columns, and moment resisting connections are needed for continuous frames. Collar beam mounts offer a valuable improvement over on-site welding techniques. Welding can be done off site in controlled conditions, and frame members are seated in the proper spatial orientation when connected by a collar beam mount.

U.S. Pat. No. 7,941,985 B2 discloses an exemplary full moment collar beam mount, described as a halo/spider connection. Where a beam and a column connect, a collar flange assembly is welded to the end of the beam. Two collar corners are welded to corners on either side of a face of the column. To connect, the beam is lowered so that the flange assembly is received between the collar corners, which form a tapered channel. Connections on all faces of the column together form a full moment collar.

The beam connections allow precise building frame construction, but also require precise manufacturing. Along the length of a building frame, many beam and column connections line up and tolerances from multiple components may additively, adversely affect another connection. This can result in undesirable overall deviation from specifications. Manufacturing tools and methods are needed to facilitate precise positioning and welding of beam connection components in the manufacturing process.

A critical factor in precise alignment between components is lifting and transporting intermediate structures in the manufacturing process. A collar flange assembly is prohibitively heavy for manual manipulation, but does not include an attachment point for an overhead crane. Yet, both the upper and lower flanges, and full collar flange assembly need to be lifted, lowered, and adjusted into correct alignment in a safe and efficient manner.

SUMMARY

The present disclosure provides systems, apparatuses, and methods relating to full moment collar component gripping apparatus. In some examples, a gripping apparatus may include a rigid housing having a slot with an engagement axis, and a shaft extending parallel to the engagement axis. The apparatus may further include a tab member on a distal end of the shaft and a rotational actuator on a proximal end of the shaft. The rotational actuator may be configured to rotate the shaft, causing the tab member to move between a hooked position and an unhooked position.

In some examples, a gripping apparatus may include a rigid housing having a slot configured for receiving a crosspiece of a full moment collar flange member along an engagement axis. The apparatus may further include a shaft extending parallel to the engagement axis, and having a tab member on a first end of the shaft and a rotational actuator on a second end of the shaft. The rotational actuator may be configured to rotate the shaft, causing the tab member to move between a hooked position and an unhooked position. In the hooked position, the tab member may contact a column-facing side of a received flange member.

In some examples, a method of lifting a full moment collar flange member may include connecting a gripping apparatus to a lifting device and receiving a crosspiece of the flange member in a slot of a rigid housing of the gripping apparatus. The method may further include rotating a handle of the gripping apparatus in a first direction to rotate a tab member to a hooked position on a column-facing side of the flange member.

Features, functions, and advantages may be achieved independently in various examples of the present disclosure, or may be combined in yet other examples, further details of which can be seen with reference to the following description and drawings.

DETAILED DESCRIPTION

Figure 1:
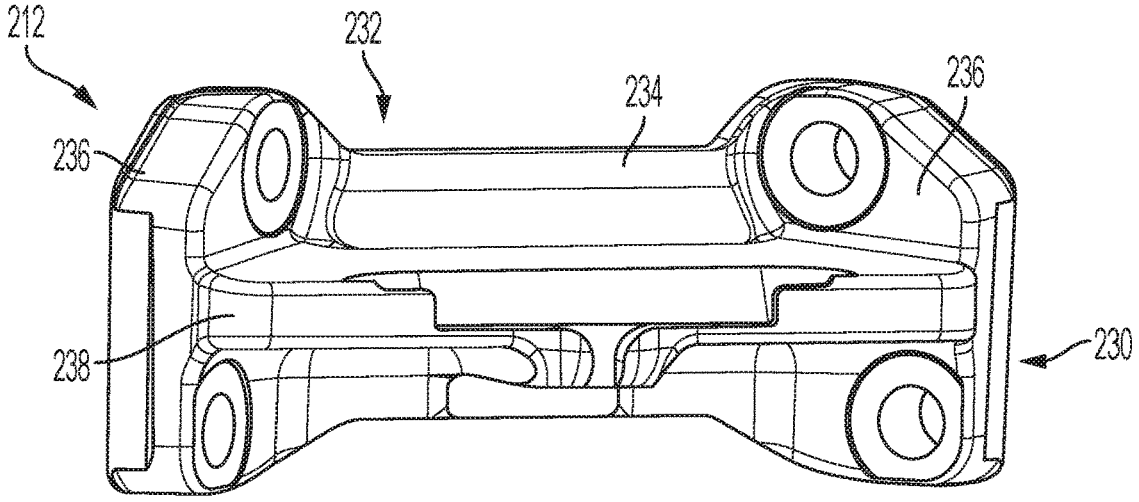
FIG. 1 is an isometric rear view of an illustrative flange member.

Various aspects and examples of a component gripping apparatus having a hook and a rotational actuator, as well as related methods of use, are described below and illustrated in the associated drawings. Unless otherwise specified, a component gripping apparatus in accordance with the present teachings, and/or its various components may, but are not required to, contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

This Detailed Description includes the following sections, which follow immediately below: (1) Overview; (2)

Examples, Components, and Alternatives; (3) Illustrative Combinations and Additional Examples; (4) Advantages, Features, and Benefits; and (5) Conclusion. The Examples, Components, and Alternatives section is further divided into subsections A through C, each of which is labeled accordingly.

Overview

In general, a component gripping apparatus may also be referred to as a flange picker, and may include a main body having a slot configured to receive a crosspiece of a full moment collar component such as a flange. The slot may define an engagement axis, along which the flange may be received. The main body may comprise a rigid housing, and the slot may be defined by a lower jaw including two spaced-apart portions. The picker may be configured to couple to the flange and to an appropriate lifting mechanism.

The flange picker may further include a connection point, a tab and a rotational actuator. The tab may be disposed at a distal end of a shaft, past or proximate an outer end of the lower jaw. The shaft may be rotatably coupled to the main body, and may be caused to rotate by the rotational actuator. The tab may be thereby rotatable between a hooked position and an unhooked position. The tab may be rotatable through at least 90 degrees, or through any appropriate range. When the tab is in the unhooked position, the crosspiece of the flange can be inserted into the slot of the main body. When the crosspiece is received in the slot and the tab is in the hooked position, the tab may contact a forward face of the flange such that the flange is thereby secured in the slot.

The rotational actuator may be disposed at a proximal end of the shaft, and may include a handle and a trigger. The trigger may include a rod that is spring-biased to engage a hole in the main body. The trigger may be configured to transition the shaft into a rotational mode, when the trigger is manipulated to disengage the rod from the main body. The handle may rotate with the shaft, and may be manipulated to rotate the tab when the shaft is in the rotational mode. The handle may also be used to manipulate the flange picker.

The connection point may be disposed on the picker such that when the picker is coupled to the flange and to a lifting mechanism, with the flange being supported solely by the picker, the flange may have a center of gravity located approximately below the connection point. That is, when the picker is in use transporting the flange, the flange may hang in a stable manner without asymmetrical tension or motion induced by gravitational forces. The connection point may be disposed such that the same is true for a coupled collar flange assembly, or the picker may include an additional connection point configured for supporting a collar flange assembly. In some examples, the picker may include a single connection point and in some examples the picker may include any number of connection points.

The picker may be configured to couple to the flange such that the flange may be manipulated in any of three dimensions, and in any orientation. That is, the picker may secure the flange laterally, longitudinally, and vertically.

Examples, Components, and Alternatives

The following sections describe selected aspects of exemplary component gripping apparatus as well as related systems and/or methods. The examples in these sections are intended for illustration and should not be interpreted as limiting the entire scope of the present disclosure. Each section may include one or more distinct examples, and/or contextual or related information, function, and/or structure.

A. First Illustrative Picker

Figure 2:
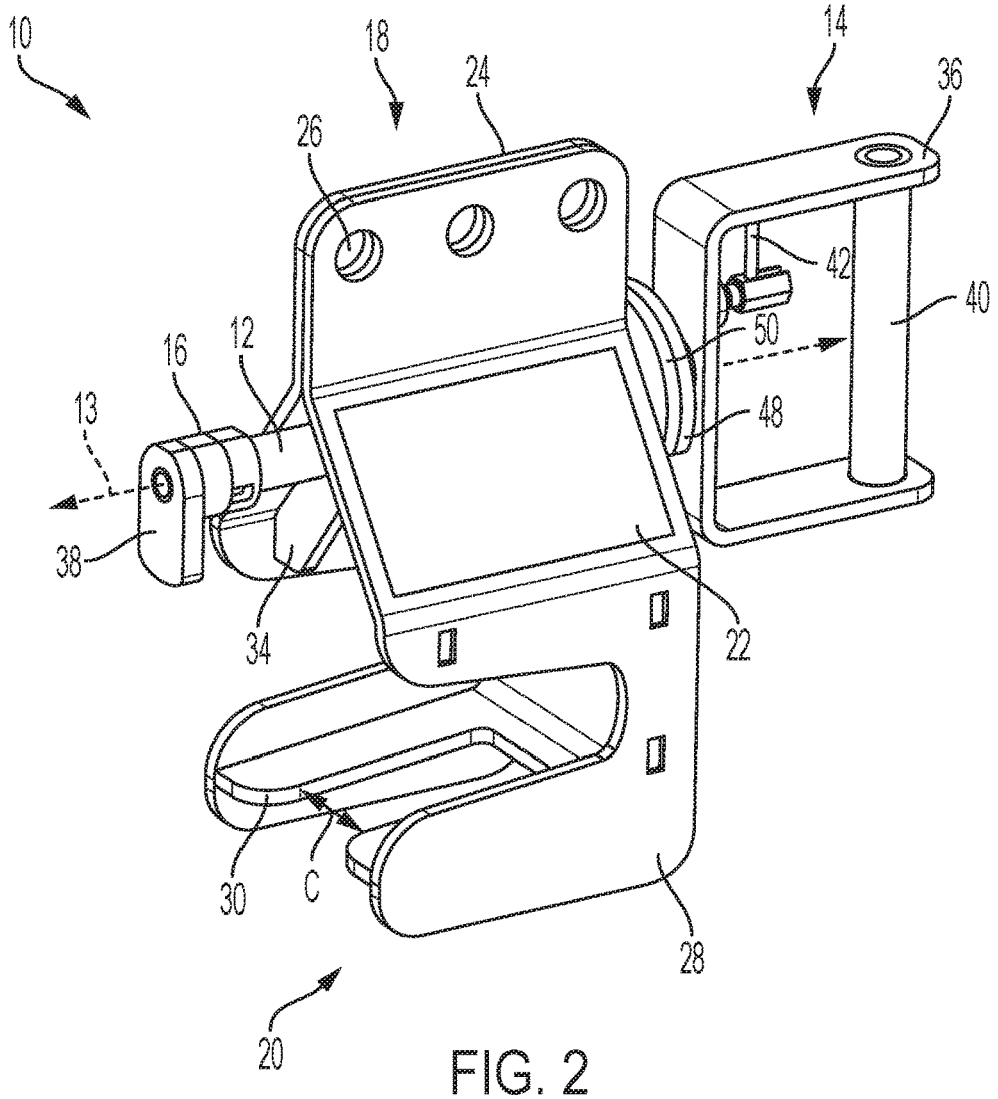
FIG. 2 is an isometric front view of an illustrative flange picker in accordance with aspects of the present disclosure.
Figure 3:
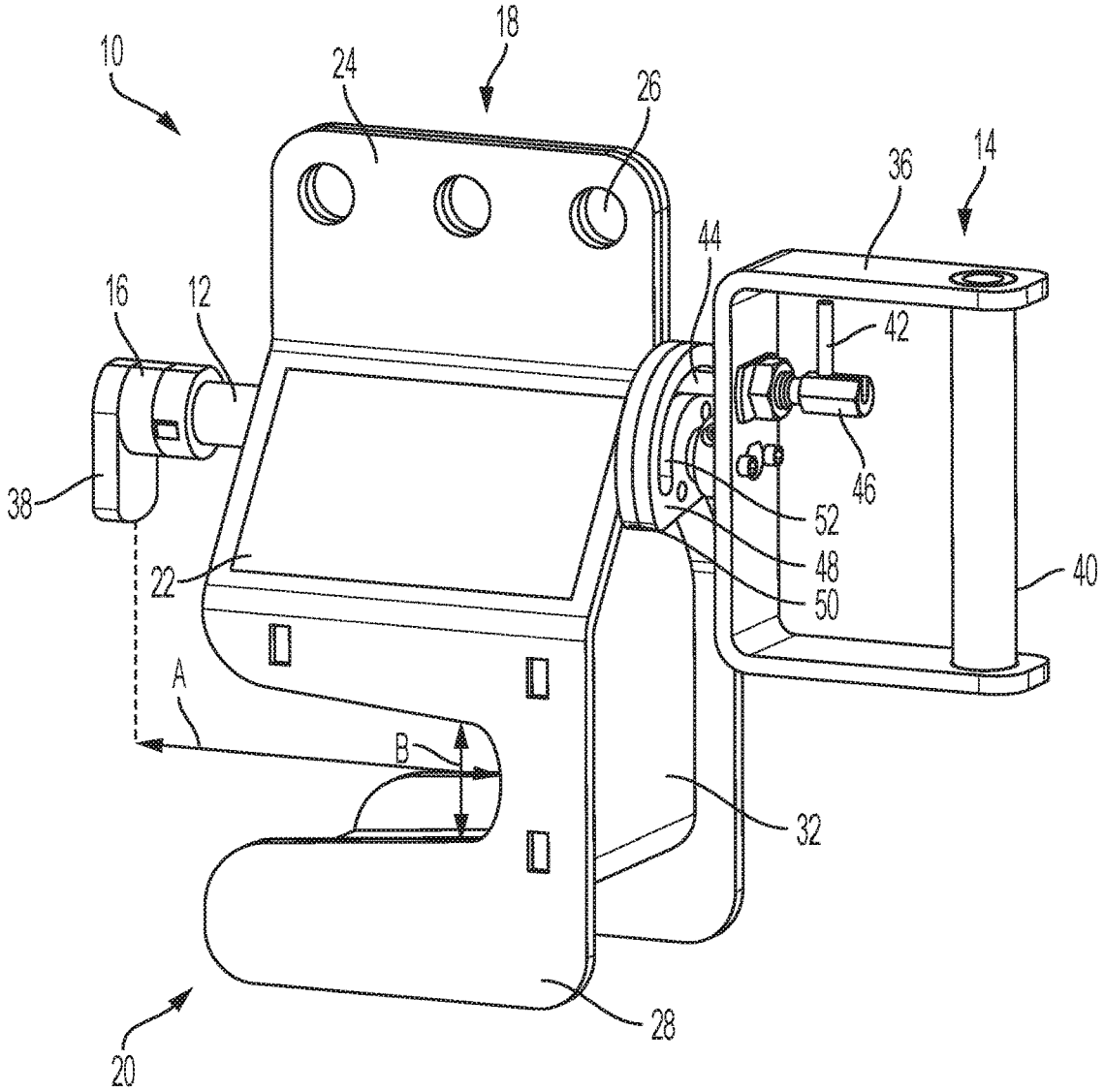
FIG. 3 is an isometric side view of the flange picker of FIG. 2.
Figure 4:
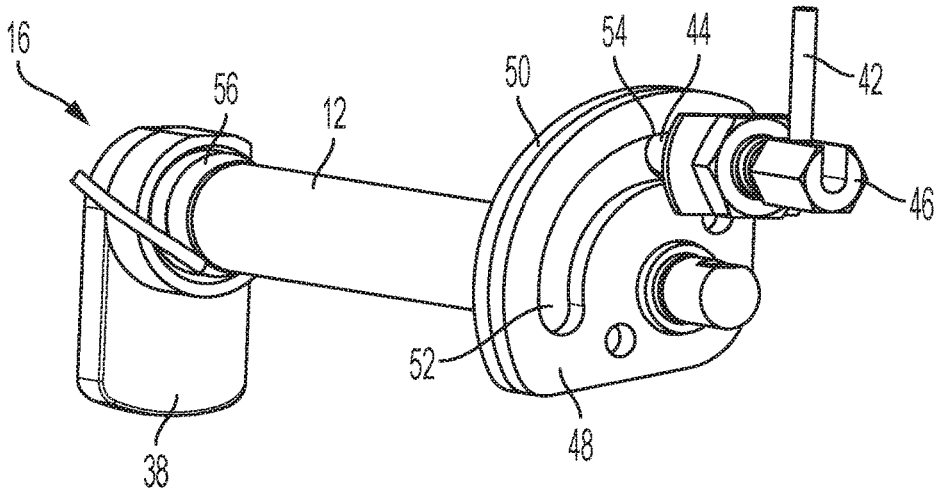
FIG. 4 is an isometric rear view of the rotational mechanism of the flange picker of FIG. 2.

As shown in FIGS. 2-4, this section describes an illustrative flange picker 10. Picker 10 is an example of a component gripping apparatus, described above. FIG. 1 is an isometric view of an illustrative flange member 212 of a collar flange assembly. A full flange assembly may further include a lower flange member and a bridging component. Upper flange member 212 and each component of the assembly have a beam facing side 230 and a column facing side 232. The flange member includes a main body with a central span 234 and angled wing portions 236 extending from each end. A crosspiece 238 extends from beam facing side 230 of the main body and wing portions. Flange picker 10 may be configured to engage crosspiece 238 of flange member 212.

As shown in FIG. 2, flange picker 10 includes an axle 12, connecting a handle 14 and a catch 16 through a main body 18. Extending down from the main body is a lower jaw 20. In the depicted example, main body 18 is generally triangular, including two side panels 22 and a top panel 24. Apertures 26 in top panel 24 function as connection points for a lifting device such as an overhead crane. For example, a shackle may be bolted to one of the apertures and the hook of a crane connected to the shackle. For another example, ropes or cables may be threaded through one or more of apertures 26. In the pictured example, three regularly spaced apertures are included disposed in a line. In other examples, any number of apertures may be included and in any appropriate pattern.

Lower jaw 20 includes two panels 28 with an internal brace 30, forming two spaced-apart projections or arms. Together with main body 18, lower jaw 20 defines a slot with dimensions and geometry appropriate to conform to an upper and/or a lower flange of a collar flange assembly of a full moment collar beam mount. Brace 30 is generally u-shaped, with a central slot or space between the two arms of lower jaw 20. Brace 30 and panels 28 are also coupled to a rear panel 32, which extends up to support side panels 22 of main body 18. A triangular brace 34 is similarly coupled to a forward end of panels 22.

Axle 12 extends through apertures in both rear panel 32 and triangular brace 34. At a rear end, the axle is fixedly coupled to a frame 36 of handle 14. At a front end, the axle is coupled to catch 16. Handle 14 may be configured to rotate a tab 38 of catch 16, by rotating axle 12 about a rotational axis 13. A handle grip 40 spans two ends of frame 36, and may be configured to be grasped by a user to rotate the handle and thereby rotate tab 38, or to guide picker 10 and in some cases a secured flange.

FIGS. 3 and 4 show an actuator mechanism of handle 14, including a trigger 42 coupled at approximately a right angle to a pin 44. The trigger and pin are slidably mounted in a housing 46, which in the present example includes a hollow bolt extending through handle frame 36 and two nuts threaded on the bolt. The two nuts are disposed on either side of the frame, thereby securing the housing relative to the frame. Pulling trigger 42 toward handle grip 40 may move pin 44 from an extended position to a retracted position. The trigger may be spring-biased such that if no force is applied to the trigger, the pin will return to the extended position unless blocked.

Two control plates, an outer plate 48 and an inner plate 50, are mounted on main body 18 proximate pin 44 and the actuator. Both plates have a rounded quarter-circle shape and an aperture through which axle 12 passes. Outer plate 48 has a channel 52 following a curved edge of the plate. Inner plate 50 has an aperture 54 located proximate a top end of channel 52, which can be seen in FIG. 4.

As shown in FIG. 4, when in extended position, pin 44 extends through channel 52 and into aperture 54. Pin 44 thereby prevents rotation of handle 14. When pin 44 is in the retracted position, the pin extends only into channel 52. The pin may slide or move along channel 52 as urged by handle 14, allowing the handle to rotate within a limited range. In an example such as the one pictured, with channel 52 following a curve of approximately a quarter-circle, handle 14 may be rotated a corresponding approximately 90 degrees. In some examples, channel 52 may have other shapes or lengths, and handle 14 may be rotatable through any appropriate range.

When in the retracted position, pin 44 may be prevented from returning to the extended position by inner plate 50 unless the pin is aligned with aperture 54. Handle 14 may therefore only lock or be securable in one position, corresponding to a position of tab 38. In the pictured example, the securable handle position corresponds to a downward extending position of tab 38. In some examples, other positions may be securable by additional apertures in inner plate 50 or by any appropriate mechanism.

FIG. 4 also shows a spring 56, mounted in catch 16. Spring 56 may bias tab 38 to return to the pictured downward extending position. This position may be referred to as a closed or locked position. Rotation of handle 14 by 90 degrees may also turn tab 38 by 90 degrees to an open position. Biasing catch 16 with spring 56 may require a user of picker 10 to maintain rotational force on handle 14 to sustain tab 38 in the open position. Therefore, by default, tab 38 may return to locked position. In the locked position, pin 44 may be urged by spring bias to extend into aligned aperture 54 and thereby automatically retain the tab in the locked position. Such automatic return to the locked position may help to ensure that a flange secured by picker 10 is correctly held by catch 16, and thereby reduce incidence of human error.

Dimensions of picker 10 may correspond or conform to dimensions of a flange of a collar flange assembly. The flange may be able to snugly fit within the grip or grasp of the picker. FIG. 3 shows dimension A measured from an innermost point of lower jaw 20 in a direction parallel to axle 12, to a point vertically below an inner face of tab 38. Dimension A may correspond to a width of a flange, as measured from rear edge of a crosspiece to a corresponding point on a front face of the flange.

Dimension B, shown in FIG. 3, measures capacity at the innermost point of lower jaw 20. Dimension B may correspond to a thickness of the crosspiece of the flange. Further, in the pictured example lower jaw 20 has an angled profile appropriate to conform to a flange crosspiece increasing in thickness from an outer edge toward the front face of the flange. The lower jaw may also have any size or shape appropriate to conform to the flange.

Dimension C, shown in FIG. 2 is a width of the slot in jaw brace 30. Dimension C may be at least corresponding to a width of a web of a collar flange assembly. The dimension may also be greater than the web width, may be smaller, or brace 30 may not include a slot.

B. Second Illustrative Picker

As shown in FIGS. 5-8, this section describes another illustrative flange picker 110. Picker 110 is another example of a component gripping apparatus, described above. Flange picker 110 also has a lower jaw 120 extending down from a main body 118. Further, the picker includes a handle 114 operatively coupled to a tab 138 by an axle 112. Many components are similar to those described in Example A. Accordingly, similar components may be labeled with similar reference numbers.

Figure 5:
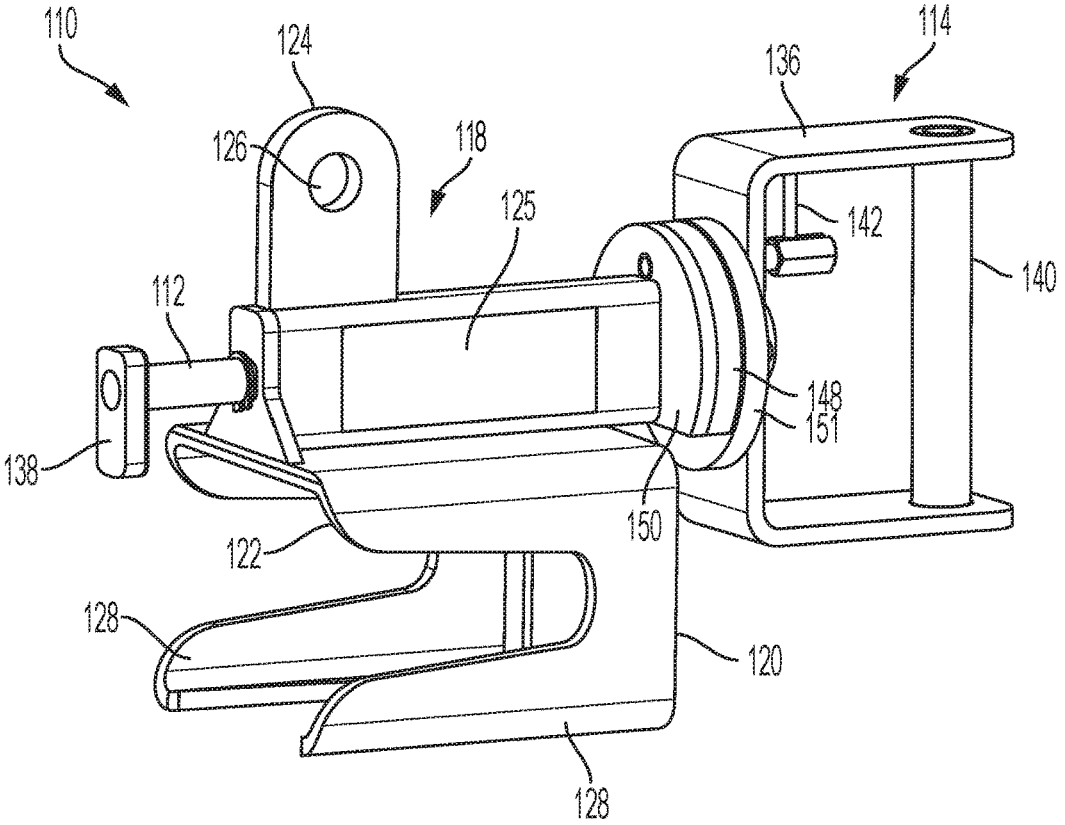
FIG. 5 is an isometric side view of another illustrative flange picker in accordance with aspects of the present disclosure.

As shown in FIG. 5, main body 118 includes a rectangular body portion 125 through which axle 112 extends. An upper jaw 122 of the main body is disposed below the rectangular body portion, and forms a unitary structure with lower jaw 120. A top panel 124 extends up from a top face of rectangular body portion 125 at a forward end of picker 110, proximate tab 138. An aperture 126 in the top panel functions as a connection point for a lifting device such as an overhead crane.

Figure 6:
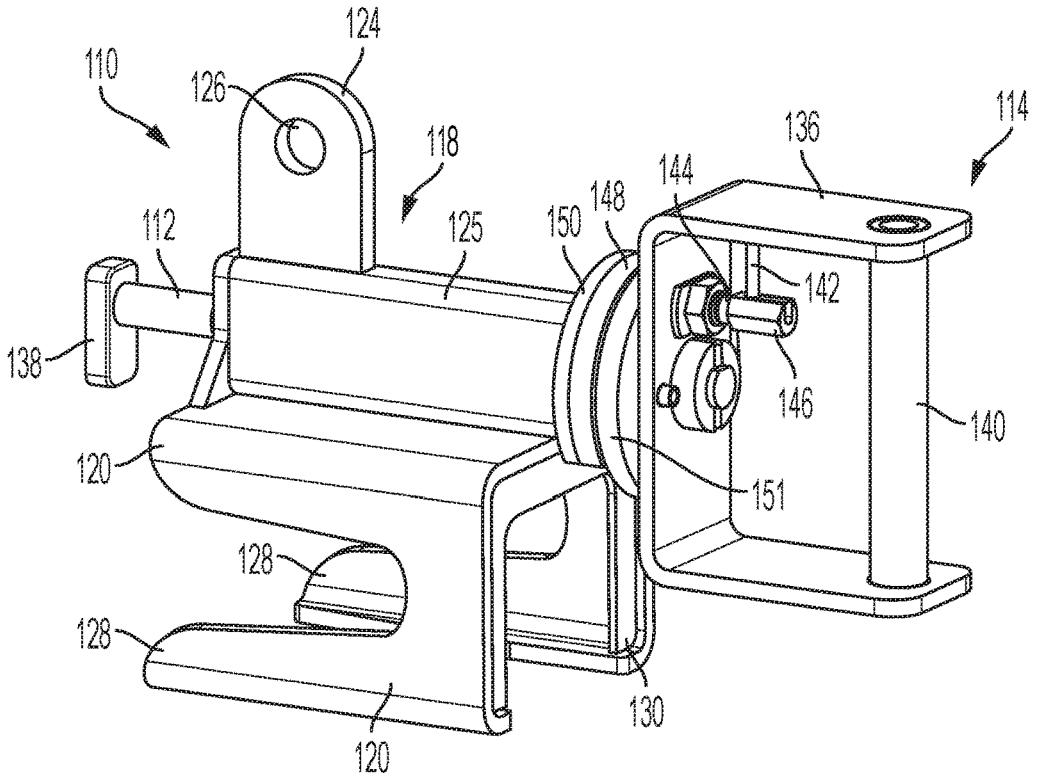
FIG. 6 is a n isometric rear view of the flange picker of FIG. 5.

Lower jaw 120 and upper jaw 122 are formed of a folded expanse, which may include one or more sheets of metal. Lower jaw 120 includes two spaced apart arm portions 128. The upper and lower jaws define a slot with dimensions and geometry appropriate to conform to a crosspiece of a flange member of a full moment collar flange assembly. As shown in FIG. 6, a generally u-shaped brace 130 is fixed at the rear of the jaw portion, to support the sides of the upper and lower jaws.

At a rear end of picker 110, axle 112 is fixedly coupled to a frame 136 of handle 114. At a front end, the axle is coupled to tab 138. Handle 114 is configured to rotate a tab 138 by rotating axle 112. A handle grip 140 spans two ends of frame 136, and may be configured to be grasped by a user to rotate the handle and thereby rotate tab 138, or to guide picker 110 and in some cases a secured flange.

FIG. 6 shows an actuator mechanism of handle 114, including a trigger 142 coupled at approximately a right angle to a pin 144. The trigger and pin are slidably mounted in a housing 146, which in the present example includes a hollow bolt extending through handle frame 136. Pulling trigger 142 toward handle grip 140 may move pin 144 from an extend position to a retracted position. The trigger may be spring-biased such that if no force is applied to the trigger, the pin will return to the extended position unless blocked.

Two control plates, an outer plate 148 and an inner plate 150, are mounted on main body 118 proximate pin 144 and the actuator. A guard plate 151 is mounted on handle frame 136.

Figure 7:
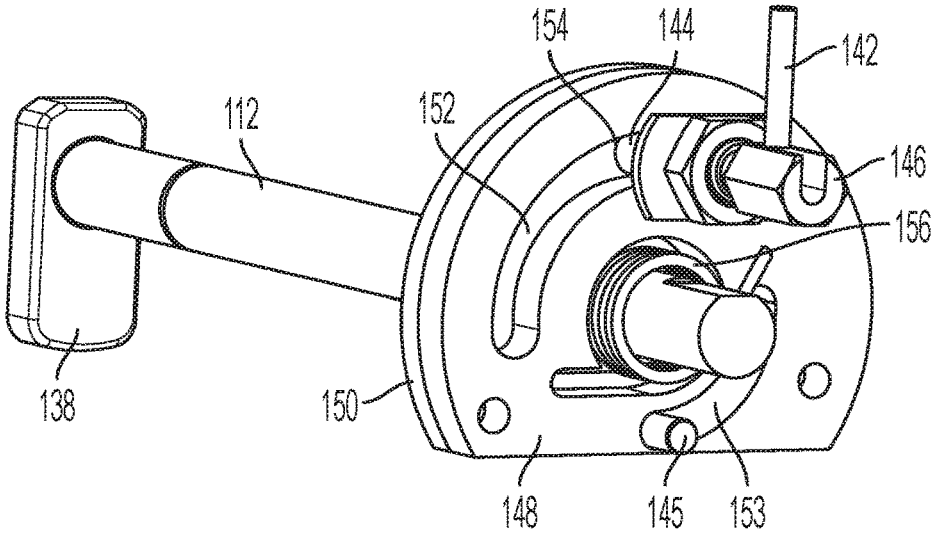
FIG. 7 is an isometric rear view of the rotational mechanism of the flange picker of FIG. 5.

As shown in FIG. 7, both control plates have a rounded semi-circle shape and an aperture through which axle 112 passes. Outer plate 148 has a first channel 152 and a second channel 153, each following a curved edge of the plate. Inner plate 150 has an aperture 154 located proximate a top end of channel 52. When in extended position, pin 144 extends through channel 152 and into aperture 154. Pin 144 thereby prevents rotation of handle 114. When pin 144 is in the retracted position, the pin extends only into channel 152. The pin may slide or move along channel 152 as urged by handle 114, allowing the handle to rotate.

A stud 145 is fixed to guide plate 151 (see FIG. 6). Stud 145 extends into channel 153 of outer control plate 148, to act as a rotational limit for handle 114. Stud 145 may slide along channel 153 as the handle rotates, and resist rotation beyond the end of the channel. A rotational range of handle 114 may be determined accordingly to an angular range of channel 153. Stud 145 may not extend or retract, and may limit rotation of handle 114 even if pin 144 is fully retracted from channel 152.

FIG. 7 also shows a spring 156, mounted on axle 112 between inner control plate 150 and guard plate 151. Spring 156 may bias axle 112 to return tab 138 to the pictured downward extending position. This position may be referred to as a closed or locked position.

Figure 8:
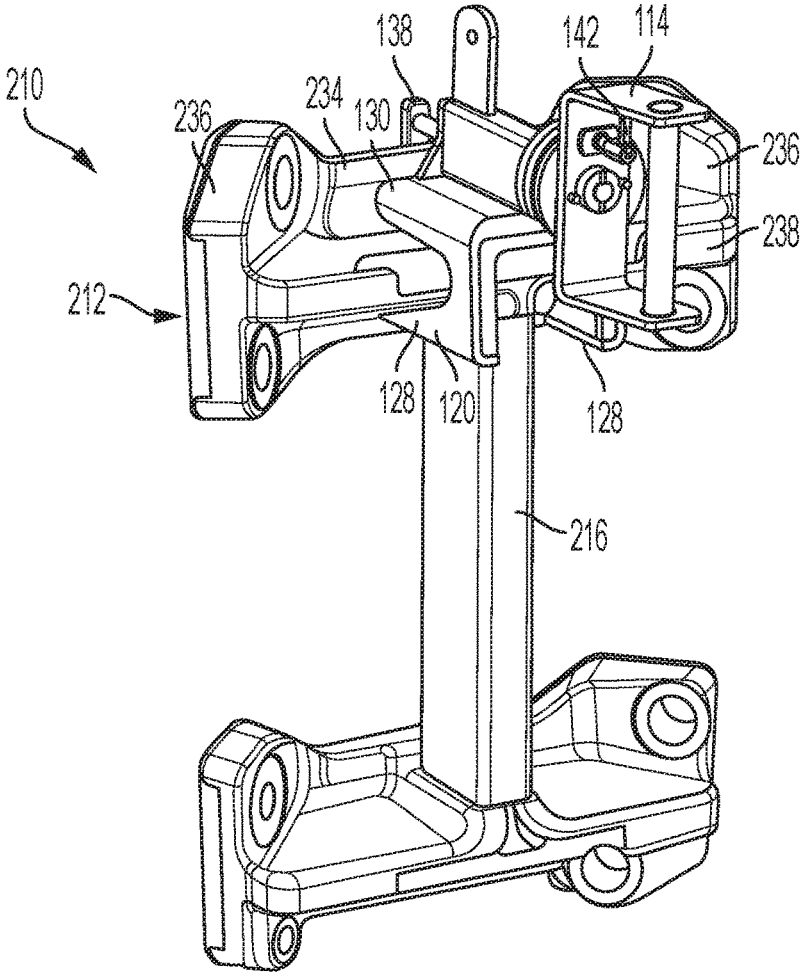
FIG. 8 is an isometric rear view of the flange picker of FIG. 5, supporting a collar flange assembly.

In FIG. 8, picker 110 is shown engaging an upper flange 212 of a collar flange assembly 210. As shown, crosspiece 238 of upper flange 212 is received between lower jaw 120 and upper jaw 122 of main body 118. Central span 234 is trapped between tab 138 and main body 118 of the picker. Arms 128 of lower jaw 120 extend on either side of a bridging component 216 of collar flange assembly 210.

When the upper flange member 212 is secured by picker 110, tab 138 may be disposed on an opposite side of central span 234 from main body 118. To this end, the tab may be rotated by handle 114 such that it remains clear of central span 234 as crosspiece 238 is received by picker 110. Such a clearance position of tab 138 may be described as an open or unlocked position. Once tab 138 is disposed on the opposite side of the central span, the tab may be rotated to cross in front of a front face of the central span. In such a position, the tab may prevent flange 212 from being removed from picker 110, and the position may be described as a closed or locked position.

In some examples, when loading a separate upper or lower flange member into the picker, left and right wings 236 of the flange may rest on a supporting surface. In such a position, with crosspiece 238 parallel to the supporting surface, lower jaw 120 may be inserted between crosspiece 238 and the surface.

C. Illustrative Method

Figure 9:
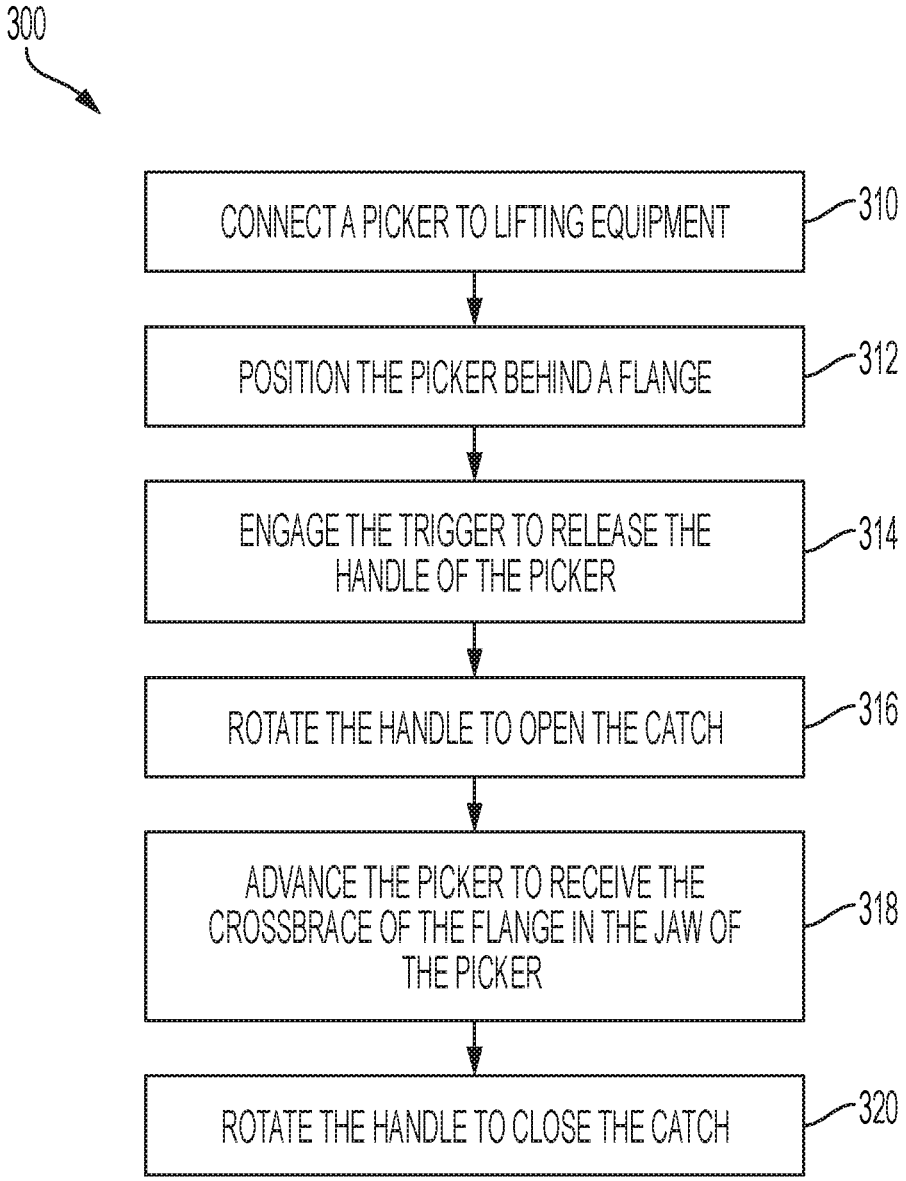
FIG. 9 is a flow chart depicting steps of an illustrative method for lifting a flange member, according to the present teachings.

This section describes steps of an illustrative method for lifting a flange or collar flange assembly; see FIG. 9. Aspects of flange pickers or component gripping apparatus described above may be utilized in the method steps described below. Where appropriate, reference may be made to components and systems that may be used in carrying out each step. These references are for illustration, and are not intended to limit the possible ways of carrying out any particular step of the method.

FIG. 9 is a flowchart illustrating steps performed in an illustrative method, and may not recite the complete process or all steps of the method. Although various steps of method 300 are described below and depicted in FIG. 9, the steps need not necessarily all be performed, and in some cases may be performed simultaneously or in a different order than the order shown.

Prior to loading into a picker, a collar flange assembly may be supported by a shelf or other storage such that clearance exists behind the crosspiece and in front of the central span of the upper flange. Step 310 of method 300 includes connecting a picker to lifting equipment. A lifting device or mechanism such as an overhead crane may be coupled to a connection point of the picker. Coupling may include but should not be limited to use of a hook, shackle, rope or bolt. The picker may be manually manipulated by a user holding a handle of the picker.

Step 312 includes positioning the picker behind a flange. The picker may be positioned with a slot, or open end of a jaw of the picker aligned with the crosspiece of the flange. The jaw may include two lower projections. In examples where the flange is part of a collar flange assembly, the lower projections may be positioned at either side of a bridging component of the collar flange assembly.

Step 314 includes engaging a trigger to release the handle of the picker. The trigger may be mounted in or proximate the handle, and may be manually engaged with the same hand as used to grasp the handle. Engaging the trigger may retract a pin, allowing the handle to rotate within a limited range. At step 316, the method includes rotating the handle of the picker to open a catch, which may be mounted at an opposite end of the picker. For example, the handle may be rotated to rotate a tab to a position clear of a top surface of the flange.

Step 318 includes advancing the picker to receive the crosspiece of the flange in the jaw of the picker. The picker may be advanced until the crosspiece is entirely received, and/or until the catch is disposed on an opposite side of the central span as the handle. Step 320 includes rotating the handle to close the catch. In the closed position, the catch may abut a front face of a central span of the flange. The flange may be thereby secured between the jaw and the catch of the picker.

Step 320 may be performed with the trigger engaged and/or with the trigger disengaged. Once the catch is closed and the flange secured, the trigger may automatically prevent rotation of the handle. The catch may remain closed until the trigger is engaged. This may prevent accidental release of the flange during transport, and improve safety for a user of the picker.

A flange may be secured separately or as part of a collar flange assembly. Once the flange or assembly has been secured, a combination of the picker and secured flange or assembly may thereby be lifted by the connected lifting equipment and transported as needed. In some examples, step 310 may be performed subsequent to step 320. Once all desired operations are complete, the picker may be removed by reversing the securing process.

Illustrative Combinations and Additional Examples

This section describes additional aspects and features of component gripping apparatus, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A. A holding device, comprising:

a housing having a slot, and a retention structure attached to the housing and configured to selectively hold a workpiece in the slot.

A1. The holding device of A, wherein the housing has a hole of attaching a lifting device.

A2. The holding device of A, wherein the slot is formed in multiple jaw members of the housing.

A3. The holding device of A, further comprising:

an actuator configured to operate transition of the retention structure between a locked position and an unlocked position.

B. A gripping apparatus, comprising:

a rigid housing having a slot configured for receiving a crosspiece of a flange along an engagement axis, a shaft extending parallel to the engagement axis, the shaft having a hook member on a distal end, and a rotational actuator on a proximal end, the rotational actuator being configured to rotate the shaft causing the hook member to move between a hooked position and an unhooked position, wherein the crosspiece is prevented from being removed from the slot when the hook member is in the hooked position.

B1. The gripping apparatus of B, wherein the actuator has a handle.

B2. The gripping apparatus of B, wherein the actuator has a trigger configured for manipulation to transition the shaft into a rotational mode.

B3. The gripping apparatus of B2, wherein the trigger includes a rod that is spring biased into a hole provided in the housing.

B4. The gripping apparatus of B1, wherein the handle rotates with the shaft

B5. The gripping apparatus of any of B-B4, further comprising:

a flange having at least one aperture for attaching a lifting device.

B6. The gripping apparatus of any of B-B5, wherein the slot is defined by two spaced-apart jaw portions, connected by a back panel.

C. A gripping apparatus, comprising:

a rigid housing having a slot with an engagement axis;

a shaft extending parallel to the engagement axis;

a tab member on a distal end of the shaft; and a rotational actuator on a proximal end of the shaft, the rotational actuator being configured to rotate the shaft, causing the tab member to move between a hooked position and an unhooked position.

C1. The gripping apparatus of C, wherein the actuator includes a handle.

C2. The gripping apparatus of C1, wherein the handle rotates with the shaft.

C3. The gripping apparatus of any of C-C2, wherein the actuator includes a trigger configured for manual manipulation to transition the shaft between a rotatable mode and a fixed mode.

C4. The gripping apparatus of C3, wherein the trigger includes a rod that is spring biased into a hole in the housing.

C5. The gripping apparatus of any of C-C4, wherein the housing includes a projection with an aperture for attaching a lifting apparatus.

C6. The gripping apparatus of any of C-C5, wherein the slot is defined by two spaced-apart jaw portions.

C7. The gripping apparatus of any of C-C6, wherein the housing includes an assembly of sheet metal pieces.

C8. The gripping apparatus of any of C-C7, wherein the shaft is spring biased to rotate the tab member to the hooked position.

C9. The gripping apparatus of any of C-C8, wherein the rotational actuator includes a rotation stop configured to limit a rotational range of the shaft.

D. A gripping apparatus, comprising:

a rigid housing having a slot configured for receiving a crosspiece of a full moment collar flange member along an engagement axis;

a shaft extending parallel to the engagement axis;

a tab member on a first end of the shaft;

a rotational actuator on a second end of the shaft, the rotational actuator being configured to rotate the shaft, causing the tab member to move between a hooked position and an unhooked position;

wherein, in the hooked position the tab member contacts a column-facing side of a received flange member.

D1. The gripping apparatus of D, wherein the actuator includes a handle which rotates with the shaft.

D2. The gripping apparatus of D or D1, wherein the actuator includes a trigger connected to a rod that is spring biased into a hole in the housing.

D3. The gripping apparatus of any of D-D2, wherein the housing includes a projection with an aperture for attaching a lifting apparatus.

D4. The gripping apparatus of any of D-D3, wherein the housing includes two spaced-apart jaw portions configured to extend on opposite sides of a bridging component of a full moment collar flange assembly when a flange member of the flange assembly is received by the slot of the housing.

E. A method of lifting a full moment collar flange member, comprising:

connecting a gripping apparatus to a lifting device;

receiving a crosspiece of the flange member in a slot of a rigid housing of the gripping apparatus; and rotating a handle of the gripping apparatus in a first direction to rotate a tab member to a hooked position on a column-facing side of the flange member.

E1. The method of E, further including rotating the handle in a second direction to rotate the tab member to an unhooked position, prior to the receiving step.

E2. The method of E1, wherein rotating the handle in second direction includes engaging a trigger to release the handle from a fixed mode.

E3. The method of E2, further including disengaging the trigger to return the handle to the fixed mode, subsequent to rotating the handle in the first direction.

E4. The method of E2 or E3, wherein the handle and the tab member are each fixed to a shaft extending through the housing, and the trigger includes a rod that is spring biased into a hole in the housing.

Advantages, Features, and Benefits

The different examples of the gripping apparatus described herein provide several advantages over known solutions for lifting and transporting flange members of a full moment collar. For example, illustrative examples described herein allow flange members to be lifted directly from storage, without prior reorientation.

Additionally, and among other benefits, illustrative examples described herein allow secure transport without the need for other tools or fasteners.

Additionally, and among other benefits, illustrative examples described herein are lightweight and can be manufactured from inexpensive materials.

Additionally, and among other benefits, illustrative examples described herein allow balanced and stable lifting of collar flange assemblies.

Additionally, and among other benefits, illustrative examples described herein improve safety for workers handling heavy components, and reduce the possibility of human error.

No known system or device can perform these functions, particularly for the specific geometry of a collar flange member. Thus, the illustrative examples described herein are particularly useful for manufacture of full moment collar connections. However, not all examples described herein provide the same advantages or the same degree of advantage.

CONCLUSION

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A gripping apparatus, comprising:

a rigid housing having a slot with an engagement axis;

a shaft having a rotational axis extending parallel to the engagement axis;

a tab member on a distal end of the shaft; and a rotational actuator on a proximal end of the shaft, the rotational actuator including a handle;

wherein rotation of the handle, shaft and tab member together through ninety degrees around the rotational axis of the shaft causes the tab member to move between a first position preventing removal of an object from the slot, and second position allowing the object to be removed from the slot.

2. The gripping apparatus of claim 1, wherein the actuator includes a trigger configured for manual manipulation to transition the shaft between a rotatable mode and a fixed mode.

3. The gripping apparatus of claim 2, wherein the trigger includes a rod that is spring biased into a hole in the housing.

4. The gripping apparatus of claim 1, wherein the housing includes a projection with an aperture for attaching a lifting apparatus.

5. The gripping apparatus of claim 1, wherein the slot is defined by two spaced-apart jaw portions.

6. The gripping apparatus of claim 1, wherein the housing includes an assembly of sheet metal pieces.

7. The gripping apparatus of claim 1, wherein the shaft is spring biased to rotate the tab member to the second position.

8. The gripping apparatus of claim 1, wherein the rotational actuator includes a rotation stop configured to limit a rotational range of the shaft.

9. A gripping apparatus, comprising:

a rigid housing having a slot configured for receiving a crosspiece of a full moment collar flange member along an engagement axis;

a shaft extending parallel to the engagement axis;

a tab member on a first end of the shaft;

a rotational actuator on a second end of the shaft, the rotational actuator being configured to rotate the shaft, causing the tab member to move between a hooked position and an unhooked position;

wherein, in the hooked position the tab member traps a received crosspiece between the tab member and the rigid housing.

10. The gripping apparatus of claim 9, wherein the actuator includes a handle which rotates with the shaft.

11. The gripping apparatus of claim 9, wherein the actuator includes a trigger connected to a rod that is spring biased into a hole in the housing.

12. The gripping apparatus of claim 9, wherein the housing includes a projection with an aperture for attaching a lifting apparatus.

13. The gripping apparatus of claim 9, wherein the housing includes two spaced-apart jaw portions configured to extend on opposite sides of a bridging component of a full moment collar flange assembly when a flange member of the flange assembly is received by the slot of the housing.

14. A method of lifting a full moment collar flange member, comprising:

connecting a gripping apparatus to a lifting device;

receiving a crosspiece of the flange member in a slot of a rigid housing of the gripping apparatus; and rotating a handle of the gripping apparatus in a first direction to rotate a tab member to a hooked position on a column-facing side of the flange member, such that the crosspiece is trapped between the tab member and the rigid housing.

15. The method of claim 14, further including rotating the handle in a second direction to rotate the tab member to an unhooked position, prior to the receiving step.

16. The method of claim 15, wherein rotating the handle in second direction includes engaging a trigger to release the handle from a fixed mode.

17. The method of claim 16, further including disengaging the trigger to return the handle to the fixed mode, subsequent to rotating the handle in the first direction.

18. The method of claim 16, wherein the handle and the tab member are each fixed to a shaft extending through the housing, and the trigger includes a rod that is spring biased into a hole in the housing.

* * * * *